US005323891A

United States Patent [19]

Waite

[11] Patent Number: 5,323,891

[45] Date of Patent: Jun. 28, 1994

[54] COIN TESTING APPARATUS

[75] Inventor: Timothy P. Waite, Esher, United Kingdom

[73] Assignee: Mars Incorporated, McLean, Va.

[21] Appl. No.: 834,299

[22] PCT Filed: Aug. 9, 1990

[86] PCT No.: PCT/GB90/01245

§ 371 Date: Feb. 18, 1992

§ 102(e) Date: Feb. 18, 1992

[87] PCT Pub. No.: WO91/03032

PCT Pub. Date: Mar. 7, 1991

[30] Foreign Application Priority Data

Aug. 21, 1989 [GB] United Kingdom ..... 8918997

[51] Int. Cl.[5] ..... G07D 5/08

[52] U.S. Cl. ..... 194/318; 324/236; 324/243

[58] Field of Search ..... 194/317, 318; 324/236, 324/232, 242, 243

[56] References Cited

U.S. PATENT DOCUMENTS 3,764,897 10/1973 Greenwood ..... 324/233
3,918,563 11/1975 Schwippert et al. .
4,086,527 4/1978 Cadot ..... 194/318 X
4,855,677 8/1989 Clark, Jr. et al. ..... 324/238
5,078,252 1/1992 Furuya et al. ..... 194/318

FOREIGN PATENT DOCUMENTS 0202378 11/1986 European Pat. Off. ..... 194/317
78209470 10/1990 Taiwan .
2120826 12/1983 United Kingdom .
2094008 2/1985 United Kingdom .

*Primary Examiner*—F. J. Bartuska
*Attorney, Agent, or Firm*—Davis Hoxie Faithfull & Hapgood

[57] ABSTRACT

A coin testing apparatus is provided in which two oscillating magnetic fields interact with a coin and these interactions are monitored to test for the acceptability and/or the presence of a coin. The fields are associated with respective inductive coils which have a common core so arranged that not more than a minor proportion of the field of one coil interacts with the other coil. In a preferred embodiment one of the two coils encircles the other, which provides a very compact two-field coin sensing arrangement. In some embodiments one coil encircles the other but they have respective core elements.

27 Claims, 2 Drawing Sheets

COIN TESTING APPARATUS

FIELD OF THE INVENTION

This invention relates to coin testing apparatus in which at least two oscillating magnetic fields are generated in the path of coins through the apparatus and means is provided for monitoring the interaction between the coin and each of the fields.

The use of two or more fields enables the apparatus to test coins for two or more different characteristics. These characteristics include coin material, coin thickness and coin diameter. In practice, it is not normally possible to test these characteristics completely independently from each other but nevertheless such multiple testing has proved to be of great value.

BACKGROUND

When a coin characteristic is being tested, the monitoring means has to make a reasonably accurate assessment of the degree of interaction between the coin and a field, to determine whether the coin meets an acceptability criterion. However, one of the fields may be used simply to detect the arrival of a coin and then, so far as that field is concerned, the monitoring means will function simply to detect whether a degree of interaction occurs which is great enough to indicate that an object which might be a coin, which has to be tested, is in the vicinity of that field, in response to which a coin testing sequence of events will be initiated in the apparatus, as is well known. It is also possible for the interaction of a coin with one of the fields to be utilized both for indicating coin arrival and also for testing against an acceptability criterion.

One way of providing an oscillating magnetic field is to place a single inductive coil adjacent to the coin path, that coil being connected as part of a self-excited oscillator circuit such as a Colpitt's oscillator circuit. Another way of producing such a field is to place two inductive coils on opposite sides of the coin path and in register with each other, these being connected together either in series opposing, series aiding, parallel opposing or parallel aiding and also forming part of a self-excited oscillator circuit. Yet another way of providing such a field is to have one coil on one side of the coin path driven by a fixed-frequency oscillator, or by dividing down the frequency of a clock circuit, and to have another coil in register with the first coil and opposed to it across the coin path, the second coil having an oscillating signal induced therein by the transmitted field, which signal will be influenced by the degree of interaction between the coin and the field when a coin passes between the two coils.

The degree of interaction between the coin and the field is detected by monitoring the electrical signal across the coil or coils in a self-excited oscillator arrangement, or by monitoring the signal across the receiving coil in a transmit-receive arrangement. In both arrangements, it may be the amplitude, the frequency, or the phase of the electrical signal that is utilised in determining whether or not a coin is acceptable or, for coin arrival sensing, whether or not a coin is present.

It has been usual, in order for two fields to interact with a coin independently of each other, to space the fields apart, by spacing apart the coils which generate or interact with the fields. This occupies, in general, twice as much space as would a single field arrangement. In coin testing apparatus, compactness is always, and increasingly, desired.

In U.S. Pat. No. 3,918,563, which did not specifically address the question of compactness, it was proposed to have two transmitting coils operating at different frequencies wound on the same core but it was then necessary to add frequency filtering circuitry so as to separate from each other the two frequencies involved to enable them to be individually monitored, for the purpose of applying the desired tests for coin acceptability.

SUMMARY OF THE INVENTION

It is one aim of the invention for the amount of space taken up by the coils which co-act with two oscillating magnetic fields to be minimised, while keeping the fields substantially independent of each other.

The invention provides a coin testing apparatus comprising means for generating at least two oscillating magnetic fields in the path of coins through the apparatus and means for monitoring the interaction between the coin and each of the fields, characterised in that the fields are respectively associated with two inductive coils one of which coils encircles the other, and that high permeability material is located between the two coils and is formed so as to ensure that no more than a minor proportion of the field associated with each coil interacts with the other coil.

The high permeability material is formed so as to ensure that no more than a minor proportion of the field associated with each coil interacts with the other coil, and the proportion that does so interact can be made small enough for the coils to be able to operate at different frequencies without the need for frequency filtering to separate their signals from each other.

By placing one coil within another in the above fashion, the total area of passageway side-wall occupied by the coils can be significantly reduced compared with the usual technique of using coils side-by-side, but the ability to monitor the interaction of the coin with two fields is retained.

In one of the embodiments to be described, a single core serves for both the inner and outer coils and so the extra assembly steps involved in placing and securing separate inductors for the two fields are avoided.

In three other embodiments, separate core elements are used for the inner and outer coils, which avoids difficulties which can arise when seeking to make a one-piece core to certain designs, due to difficulties in reliably staying within tolerance limits using current ferrite forming techniques. In one of these embodiments, the magnetic circuits of the two core elements are kept completely separate by having two parallel walls located between the two coils, with a low magnetic permeability gap between them, so that each of these walls directs its respective magnetic field separately into the coin space. In the other two embodiments, the coils also have separate core elements; a single wall of high permeability material which is part of one element separates the two coils, as in the one-piece concentric embodiment, but there is a low-permeability gap between that wall and the other core element. The magnetic field of one of the coils passes across, or jumps, this gap so as to be able to share the common wall with the field of the other coil. In these embodiments two components will have to be positioned and fixed when assembling the apparatus unless the two coils with their respective core elements are pre-assembled into a single unit using perhaps an adhesive low-permeability material to fill the annular gap between them and secure them together.

It is mentioned at this point that in a coin mechanism sold by the Sanyo company of Japan and designated VE 602 two coils of substantially the same diameter were fitted one on top of the other into the single annular recess in a ferrite core of generally E-shaped diametral cross-section, a third coil being located encircling the ferrite core but having no core of its own. One of the inner coils was driven, the outer coil was very weakly inductively coupled with it and served to pick up the field generated by the driven coil, and the other inner coil was tightly inductively coupled to the driven coil and served to provide a reference signal against which the phase of the signal induced in the outer coil could be measured. This phase is believed to be influenced by a property of a coin passing closely adjacent to the three coils.

It is to be noted that arrangement does not utilise two oscillating magnetic fields and so cannot carry out two tests upon a coin, and, indeed it requires three coils for the purpose of carrying out a single test. In contrast, the present invention enables two coin tests to be applied, using only two coils which occupy an area and a length of coin path substantially less than that which would be occupied by two side-by-side coils.

BRIEF DESCRIPTION OF THE DRAWINGS

In order that the invention may be more clearly understood, some embodiments thereof will now be described with reference to the accompanying diagrammatic drawings in which.

DETAILED DESCRIPTION

Figure 1:
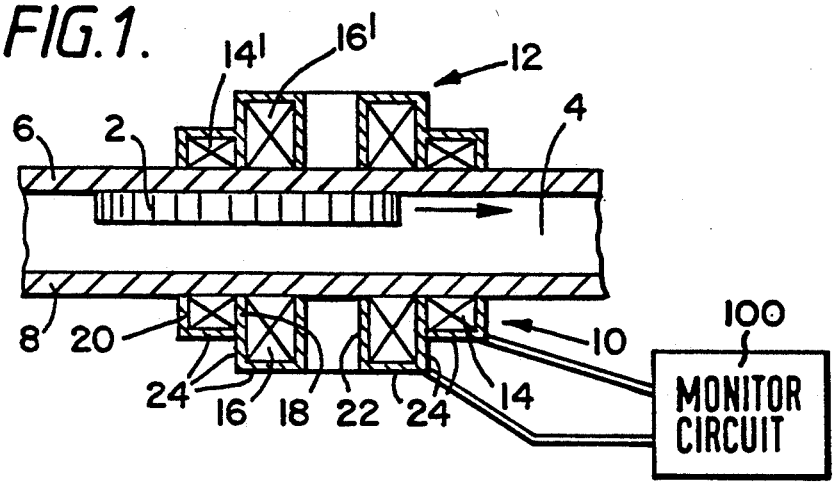
FIG. 1 shows in cross-section a coin sensing configuration comprising an opposed pair of inductor units, each unit including two coils one of which encircles the other.

Referring to FIG. 1, the cross-section is taken looking downwardly into the coin path of a typical coin testing apparatus in which the coin 2 is rolling (from left to right) along a coin track 4 which is inclined so as to cause the coin to roll. Respective side walls 6 and 8 lie to either side of the coin track 4 so as to limit the lateral movements of the coin and, normally, the walls 6 and 8 are inclined to the vertical so that the coin is constrained, as shown, to roll in contact with one of the walls, in this case the wall 6.

A first inductor unit 10 is secured, for example by the use of suitable adhesive, to wall 8 and a second and identical inductor unit 12 is similarly secured to the wall 6.

One of the inductor units, 10, will be described in detail with reference to FIGS. 1 and 2. Inductor unit 10 comprises an outer coil 14 which encircles an inner coil 16, the coils 14 and 16 being in this instance concentric with each other.

Coils 14 and 16 are mounted in a single body of high-permeability material, such as ferrite, which comprises an annular wall portion 18 located between the two coils, an annular peripheral wall portion 20 located around the outer coil 14, a central portion 22 which is encircled by the inner coil 16, and a back portion 24 which overlies both of the coils and links walls 18, 20 and 22.

It has been found, somewhat surprisingly, that the magnetic circuit of outer coil 14, when it is supplied with electric current, is confined substantially entirely to the outer peripheral wall 20, that part of the back portion 24 which overlies coil 14, and the wall portion 18 which separates coils 14 and 16, and then extends from the edge face of wall portion 18 out into the coin passageway in a loop which comes back to the edge face of peripheral wall portion 20. Thus the magnetic circuit is of a generally toroidal shape and does not extend around the windings of the inner coil 16.

Similarly, the magnetic circuit of the inner coil 16 is through the central wall portion 22, radially outwardly through the part of the back portion 24 which overlies coil 16, through that part of back portion 24 which leads towards the wall portion 18, on through the wall portion 18 and out through its edge face into the coin path and then in a loop from there back to the edge face of the inner wall portion 22. Thus, again, the magnetic circuit is generally of a toroidal shape and does not encompass any of the windings of the outer coil 14.

Figure 6A:
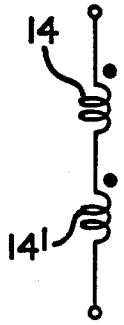
FIGS. 6A, 6B, 6C and 6D are schematic diagrams illustrating the coil connections for the series aiding, series opposing, parallel aiding and parallel opposing configuration, respectively.
Figure 6B:
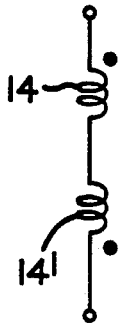
Figure 6C:
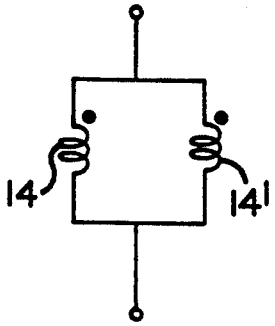
Figure 6D:
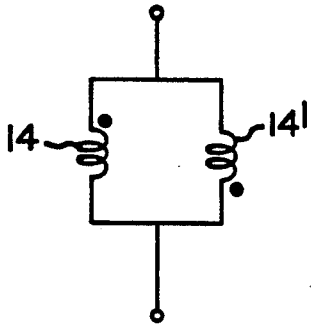
Figure 7A:
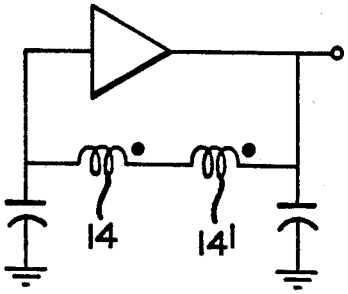
FIGS. 7A, 7B, 7C and 7D show a self-exciting oscillator circuit having the sensor coil configurations of FIGS. 6A–6D, respectively.
Figure 7B:
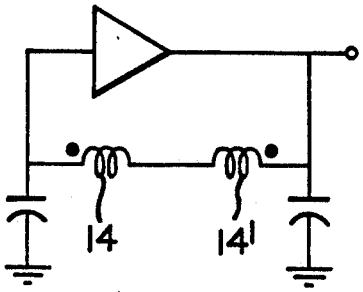
Figure 7C:
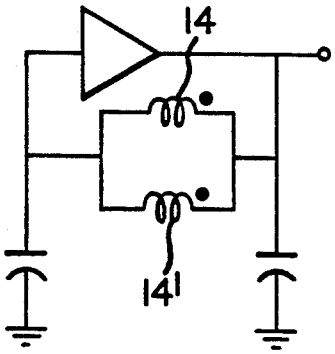
Figure 7D:
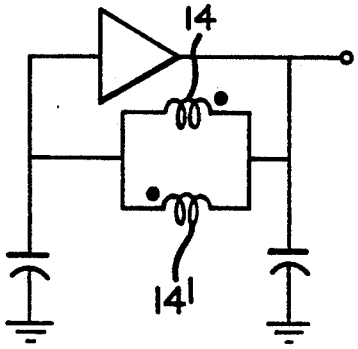

The above describes the magnetic circuits when only the inductor unit 10 is energized. In the particular configuration shown, the outer coil 14 of inductor unit 10 and the outer coil 14' of inductor unit 12 are intended to be connected together in parallel aiding (see FIG. 6A) so that together they form the frequency-determining inductance in a Colpitt's oscillator circuit. Consequently, they are energized together, in which case the magnetic circuit of the two of them is a more elongated toroid, extending around the three high-permeability portions which immediately surround coil 14' in just the same way as it extended around the equivalent portions surrounding coil 14. The inner coils 16 and 16' are also intended to be connected into a Colpitt's oscillator circuit in parallel aiding and their magnetic circuit will have the same basic elongated toroidal pattern as that of the two coils 14 and 14'.

When both of the Colpitt's oscillators are running, the oscillating magnetic fields of both of the coil pairs 4, 14' and 16, 16' expand and contract but the field of one coil pair does not cut the wires of the other coil pair so that the two coil pairs are able to operate electromagnetically quite independently of each other. It should be mentioned that this is the ideal situation and that in practice there is some degree of interaction between the field generated by each coil and the windings of the coil inside (or outside) it but this can be made insufficiently significant to prevent satisfactory operation of the arrangement.

By running the oscillator circuit containing the inner coils 16 and 16' at about 100 kHz the maximum amplitude shift caused as a coin rolls between the two coils is indicative primarily of the material the coin is made of. By running the Colpitt's oscillator which includes the outer coils 14 and 14' at a frequency of about 1 MHz, the maximum frequency shift as the coin passes them is indicative primarily of the thickness of the coin. Coin testing techniques using a monitor circuit to monitor two different frequencies, and the benefits to be derived therefrom, are explained in U.S. Pat. No. 3,870,137 and further information on the measurement of coin material, thickness and diameter can be found in GB-A-2,094,008. The techniques referred to in these prior patents and many others can generally be used with the concentric coil configuration shown in FIGS. 1 and 2 (and also those shown in FIGS. 3 to 5).

In particular, it should be mentioned that in many situations coils are not operated in pairs, opposed across the coin path, but rather a single coil is placed adjacent the coin path, and forming part of a self-excited oscillator circuit, and a characteristic of the signal in the coil is influenced by a coin which interacts with the oscillating magnetic field generated in the coin path by the coil. A single one of the inductive units shown in FIG. 1, for example the unit 10, can be operated as two such single-sided coils. Whether the coils are used in double-sided or single-sided configurations, it will be appreciated that they enable two tests to be applied to the coin by coils which occupy substantially less area of the coin path side walls than would separate circular coils in pot cores spaced laterally apart from each other, which is the usual arrangement.

It will be evident from the above explanation that the field of one coil does not substantially interact with the wires of the other coil, so that where different frequencies are used it is not necessary to employ frequency filtering circuits in order to sufficiently accurately detect what effects coin characteristics are having upon the two different frequency fields.

As described with reference to FIGS. 1 and 2, both coil pairs 14, 14' and 16, 16' are part of respective self-excited oscillator circuits (see FIGS. 7A–7D). However, it is possible for either or both of the pairs of opposed coils to be operated in a transmit/receive mode as was described earlier.

Figure 2:
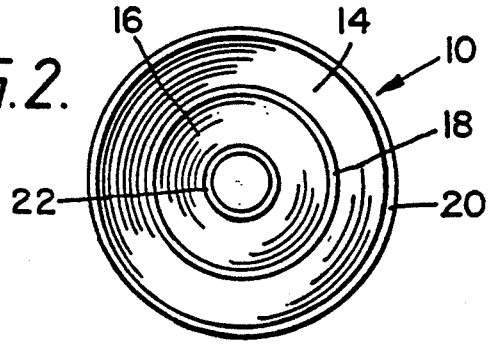
FIG. 2 shows a plan view of one of the inductor units of FIG. 1, looking towards the face where the coils are exposed.

It should also be mentioned that the outer coil pair 14, 14' of FIGS. 1 and 2 might be used to sense coin arrival as well as coin thickness in the manner explained in GB-A-2,094,008.

Figure 3:
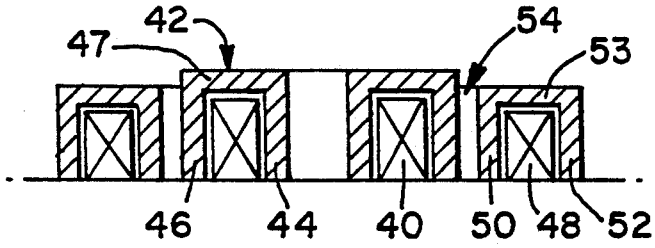
FIGS. 3, 4 and 5 show in cross-section three different configurations of two coils, in each of which one of the coils encircles the other, and there is a gap between the cores of the respective coils.

Turning now to FIG. 3, this shows a cross section through two concentric inductors which could be used instead of each of the inductor units 10 and 12 in FIG. 1. The inner inductor comprises a coil 40 set in an annular recess in the face of an annular core 42 having inner and outer walls 44 and 46, the core also having a back portion 47 which lies behind the coil 40 and joins the wall portions 44 and 46. The outer inductor is similar to the inner inductor, comprising a coil 48 in a recess between inner and outer side walls 50 and 52, which are joined by a rear wall 53, but the outer inductor is of larger diameter than the inner one so that it can encircle it, there being a gap 54 of annular shape between the two cores. The walls 46 and 50 ensure that the magnetic circuit of each of the coils is confined to its own core and therefore does not substantially cut or intersect the wires of the other coil. A shield, such as a copper ring, could be fitted between walls 46 and 50 to achieve total magnetic isolation. Because one coil encircles the other, the FIG. 3 arrangement provides the same advantages, of occupying reduced area and coin track length, as does the FIG. 1 arrangement, but not to quite the same degree. However, it does need to be manufactured in more parts, and does not give the economy in high-permeability material, and in space occupied, that is achieved by having some of that material shared between the magnetic circuits of the two coils in the embodiment shown in FIGS. 1 and 2.

Figure 4:
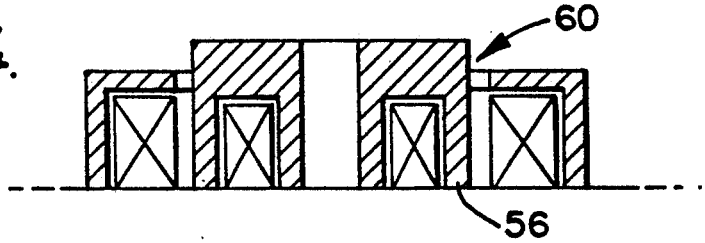
Figure 5:
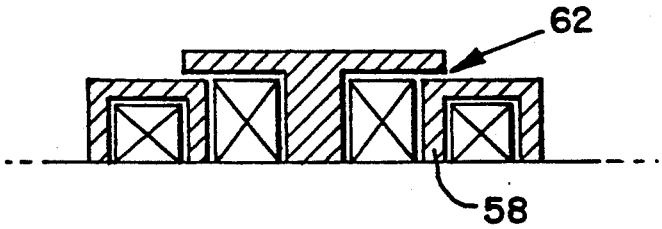

In the two further embodiments shown in FIGS. 4 and 5, it will be evident that again there are inner and outer coils, each coil having its own core element of the cross-section shown. Unlike the FIG. 3 embodiment, but like the embodiment of FIGS. 1 and 2, the magnetic circuits of the inner and outer coils share the cylindrical ferrite wall 56 in the FIG. 4 embodiment, or the cylindrical wall 58 in the FIG. 5 embodiment. In the FIG. 4 embodiment, the magnetic field of the outer coil passes across the low permeability gap 60 from the L-shaped core element of the outer coil to the shared wall 56, whereas in the FIG. 5 embodiment, the magnetic field of the inner coil passes across the gap 62 from the T-shaped core element of the inner coil to the shared wall 58. In both cases the configuration is such that the field which passes across the gap is primarily confined to the shared wall and no more than a minor proportion spreads to cut the wires of the other coil.

It is desirable, in all the embodiments, to use flux levels in the adjacent magnetic circuits which are not widely different from each other because, if they are very widely different, interaction of even only a small proportion of the flux from the high-flux circuit with the coil of the low-flux circuit could cause an unacceptable degree of interference with correct operation of the low-flux circuit by modulating its output to an undesirable degree.

Such an effect could be reduced by exciting the circuits one at a time but, even in this case, if there is excessive magnetic coupling between two adjacent coils, one coil may load the other to an extent which undesirably masks the effect of the coin itself.

The amount of interaction between the field of one coil, and the other coil, that can be tolerated will depend on the type of signal processing to be applied. For example, in the embodiment described above with reference to FIG. 1, for the purpose of monitoring the frequency of the 1 MHz signal by a monitor circuit 100 it can be amplified and then squared by an inverter to develop a square-wave pulse train suited for digital processing. A degree of modulation at 100 KHz due to flux leakage between the two circuits will then not be a problem because so long as the 1 MHz signal always crosses the inverter thresholds only the pulse width of the square-wave pulse chain will become modulated, and not its frequency, so that the accuracy of the measurement will not be affected.

Nevertheless, it is unlikely that useful results can be obtained if 50% or more of the field associated with one coil is permitted to interact with the other coil. It is preferable for this proportion to be 20% or less but, depending upon the accuracy required and the particular configuration and types of signal processing used, up to 30% or even 40% may be tolerable.

In FIGS. 3, 4 and 5, the small gap between the two core elements can accommodate dimensional variations which occur when using present techniques for the formation of ferrite cores.

It is generally desirable for the thickness of each of the cylindrical walls of high permeability material to be the minimum consistent with the constraints imposed by manufacturing techniques. Wall thicknesses less than 2 mm are easily achieved and in practice any or each of the walls can be made with a thickness of approximately 1 mm.

I claim:

1. A coin testing apparatus comprising means for generating at least two oscillating magnetic fields in the path of coins through the apparatus and means for monitoring the interaction between the coin and each of the fields, wherein the fields are respectively associated with two inductive coils located on the same side of the coin path, wherein one of the coils encircles the other, and that high permeability material is located between the two coils and is formed so as to ensure that no more than a minor proportion of the field associated with each coil interacts with the other coil.

2. A coin testing apparatus as claimed in claim 1 wherein said high permeability material is part of a single body of high permeability material which contacts with and shapes the magnetic circuits of both coils.

3. A coin testing apparatus as claimed in claim 2 characterised in that the coils lie in respective recesses in the same face of the single body of high permeability material.

4. A coin testing apparatus as claimed in claim 1 characterised in that the magnetic circuits of both coils share high permeability material located between the two coils.

5. A coin testing apparatus as claimed in claim 4 characterised in that each coil has its own core element of high magnetic permeability material, said shared material is part of the core element of the inner coil, and the magnetic circuit of the outer coil passes across a low permeability gap between the outer coil core element and the shared material.

6. A coin testing apparatus as claimed in claim 4 characterised in that each coil has its own core element of high magnetic permeability material, said shared material is part of the core element of the outer coil, and the magnetic circuit of the inner coil passes across a low permeability gap between the inner coil core element and the shared material.

7. A coin testing apparatus as claimed in claim 1 characterised in that each coil has its own core element of high permeability material, and each of the core elements has a wall which is located between the coils, the walls being separated by a low permeability gap and each wall being in the magnetic circuit of only one coil.

8. A coin testing apparatus as claimed in claim 1 characterised in that the two coils are concentric.

9. A coin testing apparatus as claimed in claim 1 characterised in that a peripheral wall portion of high permeability material is located around the outer coil.

10. A coin testing apparatus as claimed in claim 1 characterised in that a central portion of high permeability material is encircled by the inner coil.

11. A coin testing apparatus as claimed in claim 1 characterised in that a back portion of high permeability material overlies the back of each of the two coils.

12. A coin testing apparatus as claimed in claim 1 characterised in that the two coils lie adjacent to a plane in which the coin travels edgewise on its path through the apparatus.

13. A coin testing apparatus as claimed in claim 1 characterised in that each of the two coils forms a frequency-determining component of a self-excited oscillator circuit.

14. A coin testing apparatus as claimed in claim 1 characterised in that the two coils are energised at different frequencies.

15. A coin testing apparatus as claimed in claim 14 wherein the monitoring means is characterised by means for deriving respective signals indicative of the degree of interaction between the coin and each of the fields from the respective oscillator circuits, said deriving means not including a frequency filter.

16. A coin testing apparatus as claimed in claim 12 characterised in that it comprises a second two inductive coils lying on the opposite side of the coin path from the first two coils and each of the second two coils being in register with a respective one of the first two coils to form two pairs of coils each pair comprising two in-register coils opposed across the coin path.

17. A coin testing apparatus as claimed in claim 16 wherein the second two coils are associated with high permeability material.

18. A coin testing apparatus as claimed in claim 16 characterised in that, in each coil pair, the coils are connected in one of:

a) series opposing
b) series aiding
c) parallel opposing
d) parallel aiding.

19. A coin testing apparatus as claimed in claim 16 characterised in that each of the coil pairs forms a frequency-determining component of a self-excited oscillator circuit.

20. A coin testing apparatus as claimed in claim 19 wherein the coil pairs are energised at different frequencies.

21. A coin testing apparatus as claimed in claim 16 characterised in that one coil of one coil pair is driven to generate one of said oscillating magnetic fields and the other coil of that coil pair has an oscillating signal induced therein by the field, a parameter of said oscillating signal being responsive to the degree of interaction between a coin and that field.

22. A coin testing apparatus as claimed in claim 21 characterised in that the coils of the other coil pair are also a driven coil and a coil having an oscillating signal induced therein by the driven coil, respectively.

23. A coin testing apparatus as claimed in claim 21 characterised in that the coils of the other coil pair are connected in one of:

a) series opposing
b) series aiding
c) parallel opposing
d) parallel aiding.

24. A coin testing apparatus as claimed in claim 23 characterised in that the coils of the other pair form a frequency-determining component of a self-excited oscillator circuit.

25. A coin testing apparatus as claimed in claim 22 characterised in that the coil pairs are energised at different frequencies.

26. A coin testing apparatus as claimed in claim 1 in which the monitoring means is responsive to the interaction of the coin with one said field to indicate presence of the coin, and to the interaction of the coin with the other said field to determine whether or not a coin acceptability criterion is met.

27. A coin testing apparatus as claimed in claim 1 wherein the monitoring means is responsive to the interaction of the coin with both of said fields to determine acceptability of the coin.

* * * * *

UNITED STATES PATENT AND TRADEMARK OFFICE

CERTIFICATE OF CORRECTION

PATENT NO. : 5,323,891

DATED : Jun. 28, 1994

INVENTOR(S) : Timothy P. Waite

It is certified that error appears in the above-identified patent and that said Letters Patent is hereby corrected as shown below:

Column 3, line 19, after "that", insert -- that --.
Column 3, line 47, "configuration" should be -- configurations --.
Column 4, line 51, "4" should be -- 14 --.

In the claims:

Claim 2, column 7, line 17, "contacts" should be -- co-acts --.

Signed and Sealed this

Second Day of April, 1996

Bruce Lehman

*Attest:*

BRUCE LEHMAN

*Attesting Officer*

*Commissioner of Patents and Trademarks*